US008261573B2

(12) United States Patent
Kim et al.

(10) Patent No.: US 8,261,573 B2
(45) Date of Patent: Sep. 11, 2012

(54) REFRIGERATOR

(75) Inventors: Kyeong Yun Kim, Seoul (KR); Jang Seok Lee, Seoul (KR); Min Kyu Oh, Seoul (KR); Youn Seok Lee, Seoul (KR); Su Nam Chae, Seoul (KR)

(73) Assignee: LG Electronics Inc., Seoul (KR)

( * ) Notice: Subject to any disclaimer, the term of this patent is extended or adjusted under 35 U.S.C. 154(b) by 564 days.

(21) Appl. No.: 12/499,115

(22) Filed: Jul. 8, 2009

(65) Prior Publication Data

US 2010/0139309 A1 Jun. 10, 2010

(30) Foreign Application Priority Data

Dec. 10, 2008 (KR) ..... 10-2008-0125066

(51) Int. Cl.
*F25D 17/06* (2006.01)

(52) U.S. Cl. ..... 62/419; 62/441

(58) Field of Classification Search ..... 62/419, 62/441, 515, 498, 298, 449, 455, 428, 407, 62/434; 321/401, 408; 454/140, 186
See application file for complete search history.

(56) References Cited

U.S. PATENT DOCUMENTS 3,421,338 A * 1/1969 Gidseg ..... 62/155
3,486,347 A * 12/1969 Gidseg ..... 62/155
3,702,544 A * 11/1972 Grinups ..... 62/414
3,712,078 A * 1/1973 Maynard et al. ..... 62/448
3,918,269 A * 11/1975 Summers et al. ..... 62/180
3,976,122 A * 8/1976 Neidhardt ..... 165/265
4,304,101 A * 12/1981 Gidseg ..... 62/187
4,638,644 A * 1/1987 Gidseg ..... 62/329
4,714,304 A * 12/1987 Sisk et al. ..... 312/406.2
4,732,009 A * 3/1988 Frohbieter ..... 62/89
4,776,182 A * 10/1988 Gidseg ..... 62/448
5,048,306 A * 9/1991 Wakatsuki et al. ..... 62/419
5,081,850 A * 1/1992 Wakatsuki et al. ..... 62/405
5,284,023 A * 2/1994 Silva et al. ..... 62/77
6,070,424 A * 6/2000 Bauman et al. ..... 62/279
6,735,976 B2 * 5/2004 Lee ..... 62/419
6,772,601 B1 * 8/2004 Davis et al. ..... 62/187
6,997,008 B2 2/2006 Lee
7,003,973 B2 2/2006 Lee
7,040,118 B2 5/2006 Jung
7,114,345 B2 10/2006 Kim et al.
7,185,509 B2 3/2007 Lee (Continued)

FOREIGN PATENT DOCUMENTS

CN 1316215 C 5/2007

(Continued)

OTHER PUBLICATIONS

Chinese Office Action dated Nov. 22, 2010 for Application No. 2009-10163898, full English translation, 19 pages.

*Primary Examiner* — Mohammad Ali
(74) *Attorney, Agent, or Firm* — Fish & Richardson P.C.

(57) ABSTRACT

A refrigerator, in which a main body includes a refrigerating chamber and a freezing chamber. A cold air generation chamber for the freezing chamber, a cold air generation chamber for the refrigerating chamber, and a machine room are provided on an uppermost part of the main body to allow for increased space in the refrigerating and freezing chambers.

20 Claims, 9 Drawing Sheets

U.S. PATENT DOCUMENTS

| | | | | |
|---|---|---|---|---|
| 7,188,490 | B2 | 3/2007 | Jeong | |
| 7,231,782 | B2 * | 6/2007 | Jung | 62/441 |
| 7,240,511 | B2 * | 7/2007 | Lee et al. | 62/353 |
| 7,322,209 | B2 | 1/2008 | Hwang | |
| 2003/0037565 | A1 * | 2/2003 | Kim et al. | 62/407 |
| 2004/0003617 | A1 * | 1/2004 | Chandler et al. | 62/256 |
| 2004/0040335 | A1 * | 3/2004 | Lee | 62/419 |
| 2004/0040338 | A1 * | 3/2004 | Lee et al. | 62/441 |
| 2004/0139763 | A1 * | 7/2004 | Jeong et al. | 62/448 |
| 2004/0163408 | A1 | 8/2004 | Kim et al. | |
| 2004/0187510 | A1 * | 9/2004 | Jung | 62/298 |
| 2004/0189164 | A1 * | 9/2004 | Hwang | 312/405 |
| 2005/0218766 | A1 | 10/2005 | Hwang | |
| 2007/0266723 | A1 * | 11/2007 | Lee et al. | 62/264 |
| 2007/0266727 | A1 * | 11/2007 | Bae et al. | 62/419 |

FOREIGN PATENT DOCUMENTS

| | | |
|---|---|---|
| JP | 7-19704 | 1/1995 |

* cited by examiner

REFRIGERATOR

CROSS REFERENCE TO RELATED APPLICATION

This application claims the benefit of the Patent Korean Application No. 10-2008-0125066, filed on Dec. 10, 2008, which is hereby incorporated by reference as if fully set forth herein.

FIELD OF THE DISCLOSURE

The present disclosure relates to a refrigerator.

BACKGROUND

A refrigerator is an apparatus that can freeze or refrigerate stored goods received inside predetermined storage chambers using a four-step cycle including compression-condensation-expansion-evaporation of cold air. A refrigerator includes a main body in which storage space is provided, a door provided in the main body to open/close the storage space, a cold air generation chamber that houses an evaporator to generate cold air, and a machine room in which apparatuses such as a compressor and a condenser are received.

SUMMARY OF THE DISCLOSURE

In one aspect, a refrigerator includes a main body, a refrigerating chamber defined at a first portion of the main body, and a freezing chamber defined at a second portion of the main body. The second portion of the main body is different than the first portion of the main body. The refrigerator also includes a cold air generation chamber for the freezing chamber defined at an uppermost part of the main body and configured to generate cold air used in regulating temperature of the freezing chamber. The refrigerator further includes a cold air generation chamber for the refrigerating chamber defined at the uppermost part of the main body and configured to generate cold air used in regulating temperature of the refrigerating chamber. In addition, the refrigerator includes a machine room defined at the uppermost part of the main body, the machine room being positioned between the cold air generation chamber for the freezing chamber and the cold air generation chamber for the refrigerating chamber.

Implementations may include one or more of the following features. For example, the freezing chamber and the refrigerating chamber may be defined in the main body in parallel with each other, the cold air generation chamber for the freezing chamber may be disposed on an uppermost surface of the freezing chamber, and the cold air generation chamber for the refrigerating chamber may be disposed on an uppermost surface of the refrigerating chamber. The cold air generation chamber for the freezing chamber and the cold air generation chamber for the refrigerating chamber may be spaced apart from each other and the machine room may be disposed in a space between the cold air generation chamber for the freezing chamber and the cold air generation chamber for the refrigerating chamber.

In some implementations, the refrigerator may include a freezing chamber evaporator and a freezing chamber cold air fan that are positioned in the cold air generation chamber for the freezing chamber. In these implementations, the refrigerator may include a cold air inlet that allows air to flow into the cold air generation chamber for the freezing chamber from the freezing chamber and a cold air outlet that allows air to discharge from the cold air generation chamber for the freezing chamber to the freezing chamber. The freezing chamber evaporator may be positioned between the cold air inlet and the cold air outlet.

The refrigerator also may include a guide duct connected to the cold air outlet, positioned inside of the freezing chamber, and configured to guide cold air discharged from the cold air outlet to an inside of the freezing chamber. The freezing chamber cold air fan may be positioned adjacent to the cold air inlet or the cold air outlet. The freezing chamber cold air fan may include a fan motor that is positioned between the freezing chamber evaporator and the freezing chamber cold air fan and along an air flow path of cold air being drawn from the freezing chamber evaporator by the freezing chamber cold air fan.

In some examples, the refrigerator may include a refrigerating chamber evaporator and a refrigerating chamber cold air fan that are positioned in the cold air generation chamber for the refrigerating chamber. In these examples, the refrigerator may include a cold air inlet that allows air to flow into the cold air generation chamber for the refrigerating chamber from the refrigerating chamber and a cold air outlet that allows air to discharge from the cold air generation chamber for the refrigerating chamber to the refrigerating chamber. The refrigerating chamber evaporator may be positioned between the cold air inlet and the cold air outlet.

Further, the refrigerator may include a guide duct connected to the cold air outlet, positioned inside of the refrigerating chamber, and configured to guide cold air discharged from the cold air outlet to an inside of the refrigerating chamber. The refrigerating chamber cold air fan may include a fan motor that is positioned between the refrigerating chamber evaporator and the refrigerating chamber cold air fan and along an air flow path of cold air being drawn from the refrigerating chamber evaporator by the refrigerating chamber cold air fan.

The machine room may define a receiving space, and the refrigerator may include a compressor and a condenser that are located in the receiving space defined by the machine room. The refrigerator also may include a cover member that is installed on a surface of the machine room in a manner that enables removal and replacement of the cover member, that is configured to cover the receiving space defined by the machine room, and that includes communication holes that are defined on the cover member and that enable communication of air between the receiving space defined by the machine room and an exterior of the refrigerator. The machine room may be positioned over an uppermost surface of the freezing chamber and an uppermost surface of the refrigerating chamber.

In another aspect, a refrigerator includes a main body, a refrigerating chamber defined at a first portion of the main body, and a freezing chamber defined at a second portion of the main body. The second portion of the main body is different than the first portion of the main body. The refrigerator also includes a cold air generation chamber for the freezing chamber defined at an uppermost part of the main body and configured to generate cold air used in regulating temperature of the freezing chamber. The refrigerator further includes a cold air generation chamber for the refrigerating chamber defined at the uppermost part of the main body and configured to generate cold air used in regulating temperature of the refrigerating chamber. In addition, the refrigerator includes a machine room provided on the uppermost part of the main body in parallel with the cold air generation chamber for the freezing chamber and the cold air generation chamber for the refrigerating chamber.

Implementations may include one or more of the following features. For example, the refrigerator may include a first guide duct that is configured to guide cold air discharged from the cold air generation chamber for the freezing chamber to the freezing chamber and that is installed in the freezing chamber. The refrigerator also may include a second guide duct that is configured to guide cold air discharged from the cold air generation chamber for the refrigerating chamber to the refrigerating chamber and that is installed in the refrigerating chamber.

In some implementations, the refrigerator may include a freezing chamber evaporator and a freezing chamber cold air fan that are installed in the cold air generation chamber for the freezing chamber. The freezing chamber cold air fan may be oriented to guide air passing through the freezing chamber evaporator toward the freezing chamber. In these implementations, the refrigerator may include a refrigerating chamber evaporator and a refrigerating chamber cold air fan that are installed in the cold air generation chamber for the refrigerating chamber. The refrigerating chamber cold air fan may be oriented to guide air passing through the refrigerating chamber evaporator toward the refrigerating chamber.

Further, the freezing chamber cold air fan may include a first motor that is positioned between the freezing chamber evaporator and the freezing chamber cold air fan and along an air flow path of cold air being drawn from the freezing chamber evaporator by the freezing chamber cold air fan. The refrigerating chamber cold air fan may include a second motor that is positioned between the refrigerating chamber evaporator and the refrigerating chamber cold air fan and along an air flow path of cold air being drawn from the refrigerating chamber evaporator by the refrigerating chamber cold air fan.

In some examples, the refrigerator may include a freezing chamber evaporator and a freezing chamber cold air fan that are installed in the cold air generation chamber for the freezing chamber. The freezing chamber cold air fan may be oriented to guide air from the freezing chamber toward the cold air generation chamber for the freezing chamber. In these examples, the refrigerator may include a refrigerating chamber evaporator and a refrigerating chamber cold air fan that are installed in the cold air generation chamber for the refrigerating chamber. The refrigerating chamber cold air fan may be oriented to guide air from the refrigerating chamber toward the cold air generation chamber for the refrigerating chamber.

The refrigerator may include a guide member that guides air discharged from the first cold air fan and that is provided around the first cold air fan. The refrigerator also may include a first cold air inlet through which air from the freezing chamber passes into the cold air generation chamber for the freezing chamber and a first cold air outlet through which air from the cold air generation chamber for the freezing chamber is discharged to the freezing chamber. The refrigerator further may include a second cold air inlet through which air from the refrigerating chamber passes into the cold air generation chamber for the refrigerating chamber and a second cold air outlet through which air from the cold air generation chamber for the refrigerating chamber is discharged to the refrigerating chamber. The freezing chamber evaporator installed in the cold air generation chamber for the freezing chamber may be positioned between the first cold air inlet and the first cold air outlet and the refrigerating chamber evaporator installed in the cold air generation chamber for the refrigerating chamber may be positioned between the second cold air inlet and the second cold air outlet.

In some implementations, the machine room may be positioned between the cold air generation chamber for the freezing chamber and the cold air generation chamber for the refrigerating chamber, and may define a receiving space. In these implementations, the refrigerator may include a compressor and a condenser that are located in the receiving space defined by the machine room. The refrigerator further may include a cover member that is installed on a surface of the machine room in a manner that enables removal and replacement of the cover member to open and close the receiving space defined by the machine room, and that includes communication holes that are defined on the cover member and that enable communication of air between the receiving space defined by the machine room and an exterior of the refrigerator.

The details of one or more implementations are set forth in the accompanying drawings and the description below. Other features will be apparent from the description and drawings, and from the claims.

DETAILED DESCRIPTION

Figure 1:
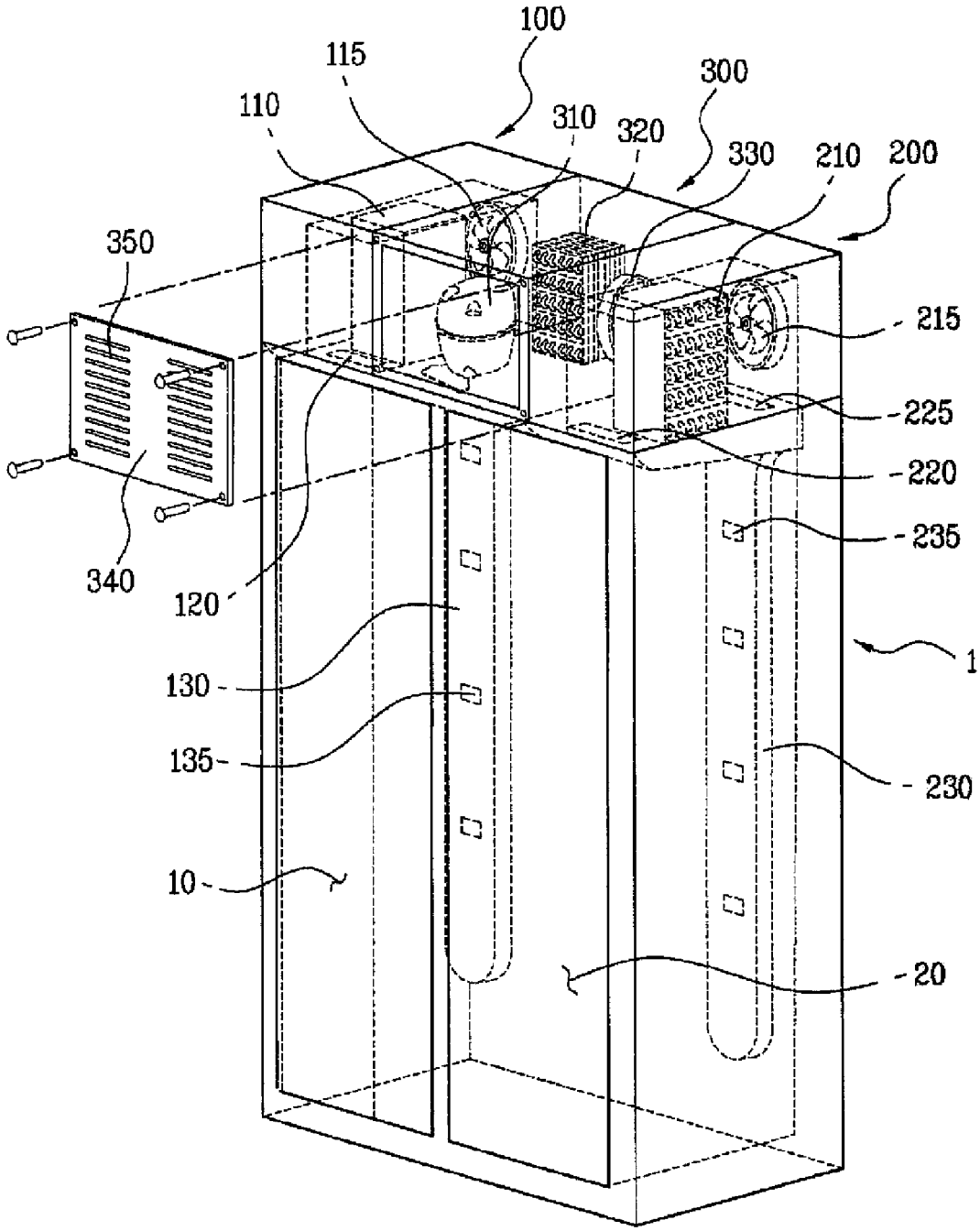
FIG. 1 is a perspective view of a refrigerator.

FIG. 1 illustrates an example of a refrigerator. The refrigerator includes a main body 1 in which a freezing chamber 10 and a refrigerating chamber 20 are provided. The refrigerator also includes a cold air generation chamber for the freezing chamber 100 and a cold air generation chamber for the refrigerating chamber 200. The cold air generation chamber for the freezing chamber 100 and the cold air generation chamber for the refrigerating chamber 200 are each provided on the upper part of the main body 1 and are configured to supply cold air to the freezing chamber 10 and the refrigerating chamber 20, respectively.

The refrigerator includes a machine room 300 in which a compressor 310, a condenser 320, and a condensation fan 330 for cooling the condenser 320 are received. The machine room 300 is provided between the cold air generation chamber for the freezing chamber 100 and the cold air generation chamber for the refrigerating chamber 200. The machine room 300 defines a predetermined receiving space in which the components of the machine room 300 are received.

A cover member 340 that covers the receiving space is provided at a front side of the machine room 300. The cover member 340 has communication holes 350 that allow external air to enter into the inside of the machine room 300 and/or allow internal air to be discharged to the outside of the machine room 300.

First and second guide ducts 130 and 230 communicate with the cold air generation chamber for the freezing chamber 100 and the cold air generation chamber for the refrigerating chamber 200 to guide cold air to the freezing chamber 10 and the refrigerating chamber 20, respectively. The first and second guide ducts 130 and 230 are provided on the rear walls of the freezing chamber 10 and the refrigerating chamber 20, respectively.

Here, the guide ducts 130 and 230 are disposed vertically along the rear walls of the freezing chamber 10 and the refrigerating chamber 20, and serve to guide the cold generated from the cold air generation chamber for the freezing chamber 100 and the cold air generation chamber for the refrigerating chamber 200 to the freezing chamber 10 and the refrigerating chamber 20, respectively. The guide ducts 130 and 230 extend along a majority of the rear walls and are configured to spread guided air evenly to the inside of the freezing chamber 10 and the refrigerating chamber 20.

Figure 2:
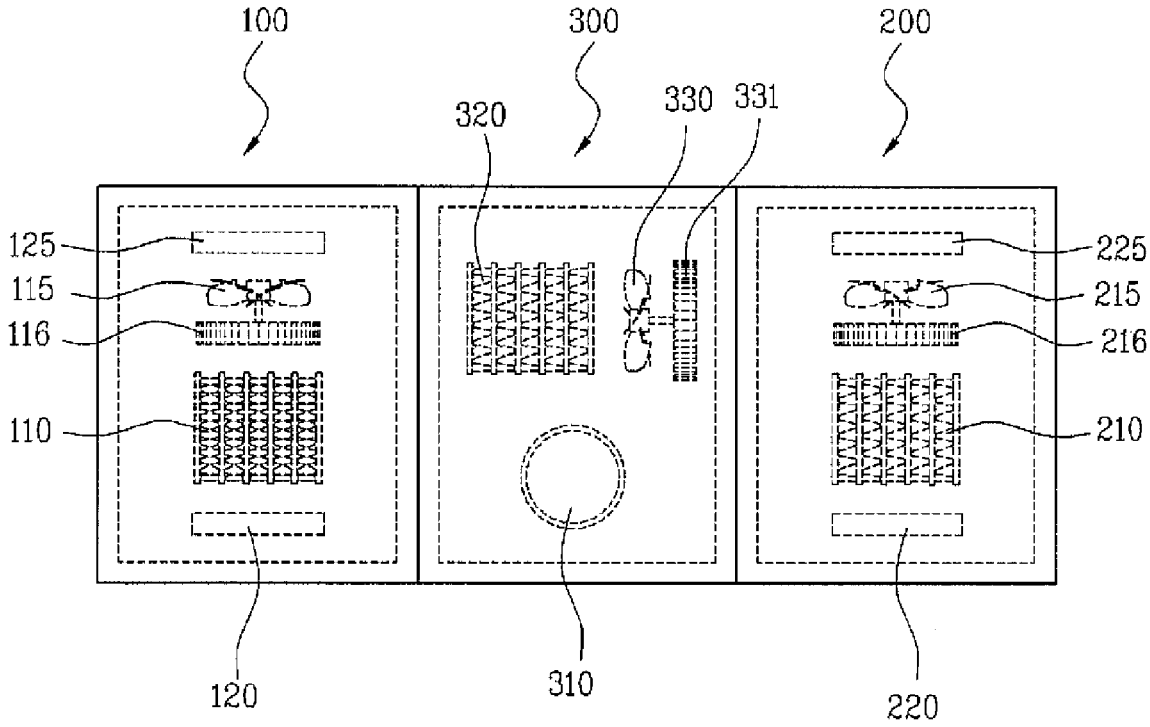
FIG. 2 is a plan view of a refrigerator.

FIG. 2 illustrates an example of the machine room 300. As shown in FIG. 2, reviewing the structure of the machine room 300, the cold air generation chamber for the freezing chamber 100 and the cold air generation chamber for the refrigerating chamber 200, the machine room 300 is disposed between the cold air generation chamber for the freezing chamber 100 and the cold air generation chamber for the refrigerating chamber 200.

Here, a freezing chamber evaporator 110 and a freezing chamber cold air fan 115 are received in the cold air generation chamber for the freezing chamber 100. The freezing chamber evaporator 110 and the freezing chamber cold air fan 115 are positioned sequentially from the front to the rear of the cold air generation chamber for the freezing chamber 100. A refrigerating chamber evaporator 210 and a refrigerating chamber cold air fan 215 are received in the cold air generation chamber for the refrigerating chamber 200.

A first cold air inlet 120 is provided in front of the freezing chamber evaporator 110. The first cold air inlet 120 allows the cold air of the freezing chamber 10 to flow into the inside of the cold air generation chamber for the freezing chamber 100. A first cold air outlet 125 (see FIG. 2) is provided below the freezing chamber cold air fan 115. The first cold air outlet 125 guides the cold air, that has passed through and been cooled by the freezing chamber evaporator 110, to be discharged to the freezing chamber 10.

In some example, the first guide duct 130 is connected to the first cold air outlet 125. The first guide duct 130 guides the cold air received from the first cold air outlet 125 to the freezing chamber 10.

In the case of the cold air generation chamber for the refrigerating chamber 200, a refrigerating chamber evaporator 210 is disposed in front thereof, and a refrigerating chamber cold air fan 215 is disposed in the rear of the refrigerating chamber evaporator 210. This arrangement is similar to the cold air generation chamber for the freezing chamber 100.

A second cold air inlet 200 is installed in front of the refrigerating chamber evaporator 210 so that the cold air of the refrigerating chamber 20 flows into the cold air generation chamber for the refrigerating chamber 200. A second cold air outlet 225 is provided in the rear of the refrigerating chamber evaporator 210. The refrigerating chamber cold air fan 215 is positioned above the second cold air outlet 225.

In this configuration, if the refrigerating chamber cold air fan 215 operates, the cold air of the refrigerating chamber 20 flows into the cold air generation chamber for the refrigerating chamber 200 through the second cold air inlet 220 and moves to the second cold air outlet 225, after passing through and being cooled by the refrigerating chamber evaporator 210.

The second cold air outlet 225 is connected to the second guide duct 230. The second guide duct 230 guides the cold air to the refrigerating chamber 20.

The machine room 300 includes a compressor 310 that compresses the cold air, a condenser 320 that condenses cold air, and a condensation fan 330 provided next to the condenser 320 to cool the condenser 320. The condensation fan 330 is powered by a motor 331.

When the compressor 310 operates to send the cold air toward the condenser 320, the condensation fan 330 operates so that air is heat-exchanged with high temperature and high pressure cold air in the condenser 320. The air used in the heat-exchanging enters one side of the front surface of the machine room 300 and is discharged to the other side of the front surface of the machine room 300.

Figure 3:
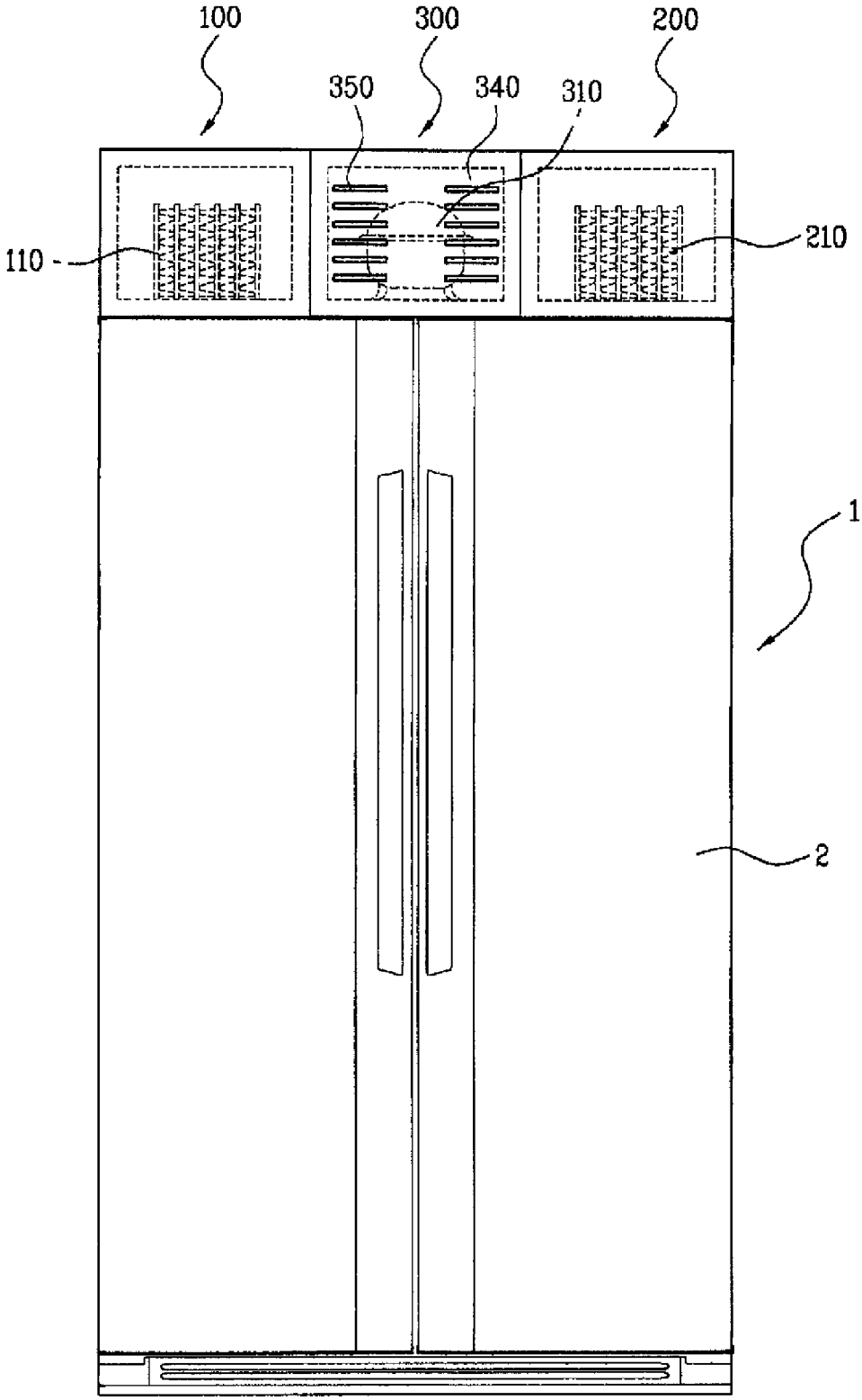
FIG. 3 is a front view of a refrigerator.

FIG. 3 shows a front surface of the refrigerator shown in FIG. 1. In this example, the machine room 300 is installed on a central portion of the upper part of the main body 1. The cold air generation chamber for the freezing chamber 100 and the cold air generation chamber for the refrigerating chamber 200 are disposed at opposite sides of the machine room 300, respectively.

However, unlike the machine room 300, the cold air generation chamber for the freezing chamber 100 and the cold air generation chamber for the refrigerating chamber 200 are blocked from the outside. Instead, the cold air generation chamber for the freezing chamber 100 and the cold air generation chamber for the refrigerating chamber 200 communicate with only the freezing chamber 10 and the refrigerating chamber 20, such that the insides thereof are not exposed to the exterior of the refrigerator In some implementations, the cold air generation chamber for the freezing chamber 100 and the cold air generation chamber for the refrigerating chamber 200 are covered with the same exterior material (e.g., an insulating wall) as the refrigerator door 2 and the main body 1.

The machine room 300 is covered with the cover member 340. The cover member 340 has the communication holes 350 that expose an interior of the machine room 300 to an exterior of the refrigerator.

Figure 4:
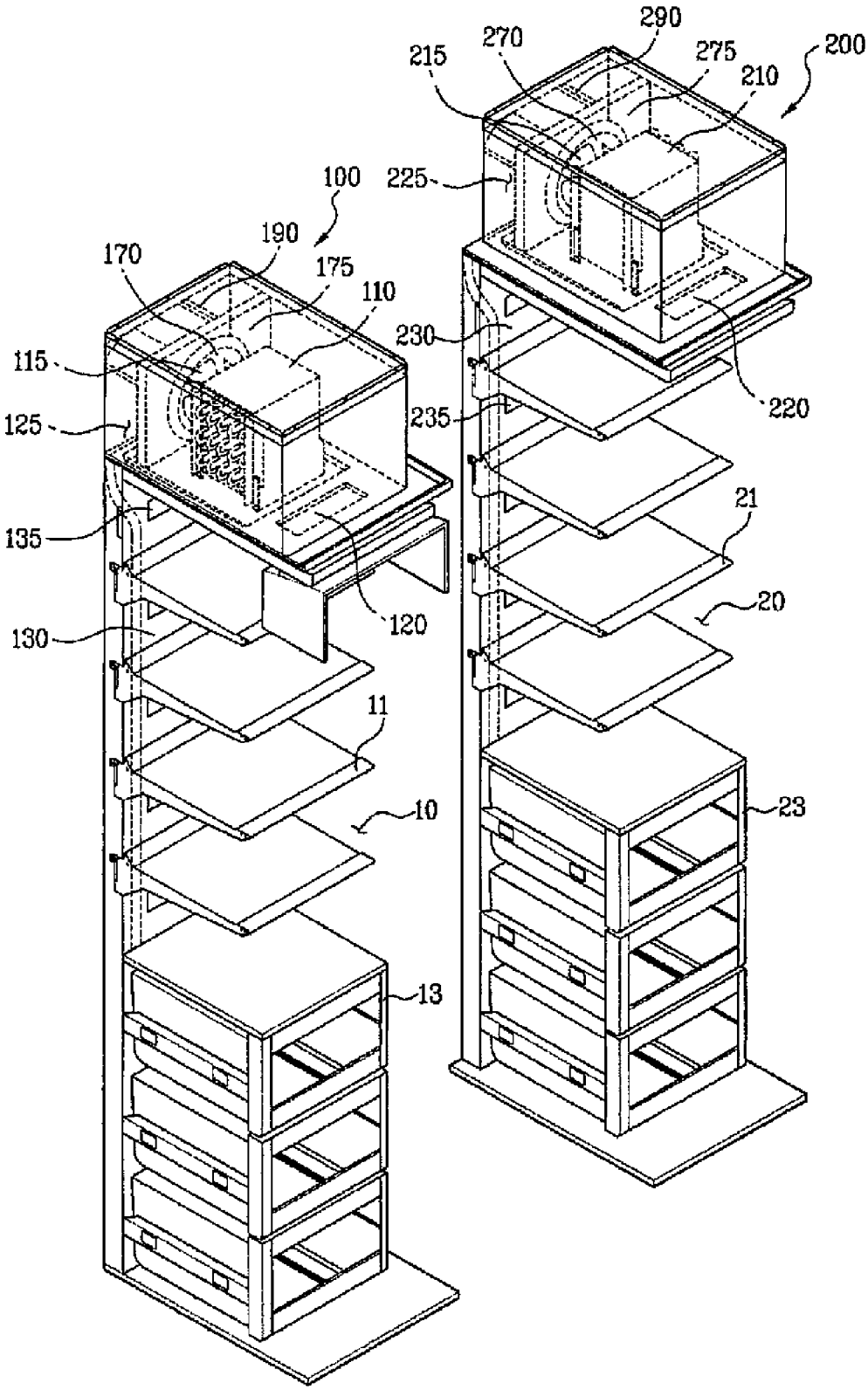
FIG. 4 is an internal structure view of a refrigerator.

FIG. 4 shows an internal structure of the freezing chamber 10 and the cold air generation chamber for the freezing chamber 100 and an internal structure of the refrigerating chamber 20 and the cold air generation chamber for the refrigerating chamber 200.

The freezing chamber 10 includes a plurality of shelves 11 that are spaced up and down therein. Drawer-type storage chambers 13 are disposed below the shelves 11. The first guide duct 130 is disposed in the rear of the shelves 11 and the drawer-type storage chambers 13. The first guide duct 130 guides cold air to the shelves 11 and the drawer-type storage chambers 13.

The cold air generation chamber for the freezing chamber 100 is disposed on the upper part of the freezing chamber 10 so that the cold air can circulate up and down.

The first cold inlet 120 is disposed in front of the freezing chamber evaporator 110, and the first cold outlet 125 is disposed in the rear of the freezing chamber evaporator 110.

The refrigerating chamber 20 and the cold air generation chamber for the refrigerating chamber 200 have a similar internal structure as the freezing chamber 10 and the cold air generation chamber for the freezing chamber 100. For instance, the refrigerating chamber 20 and the cold air generation chamber for the refrigerating chamber 200 include a refrigerating chamber evaporator 210, a refrigerating chamber cold air fan 215, shelves 21, storage chambers 23, etc. A cold air circulation mechanism is similar to the internal structure of the freezing chamber 10 and the cold air generation chamber for the freezing chamber 100, except that the temperature of the circulating cold air is higher than the cold air used in the freezing chamber.

Figure 5:
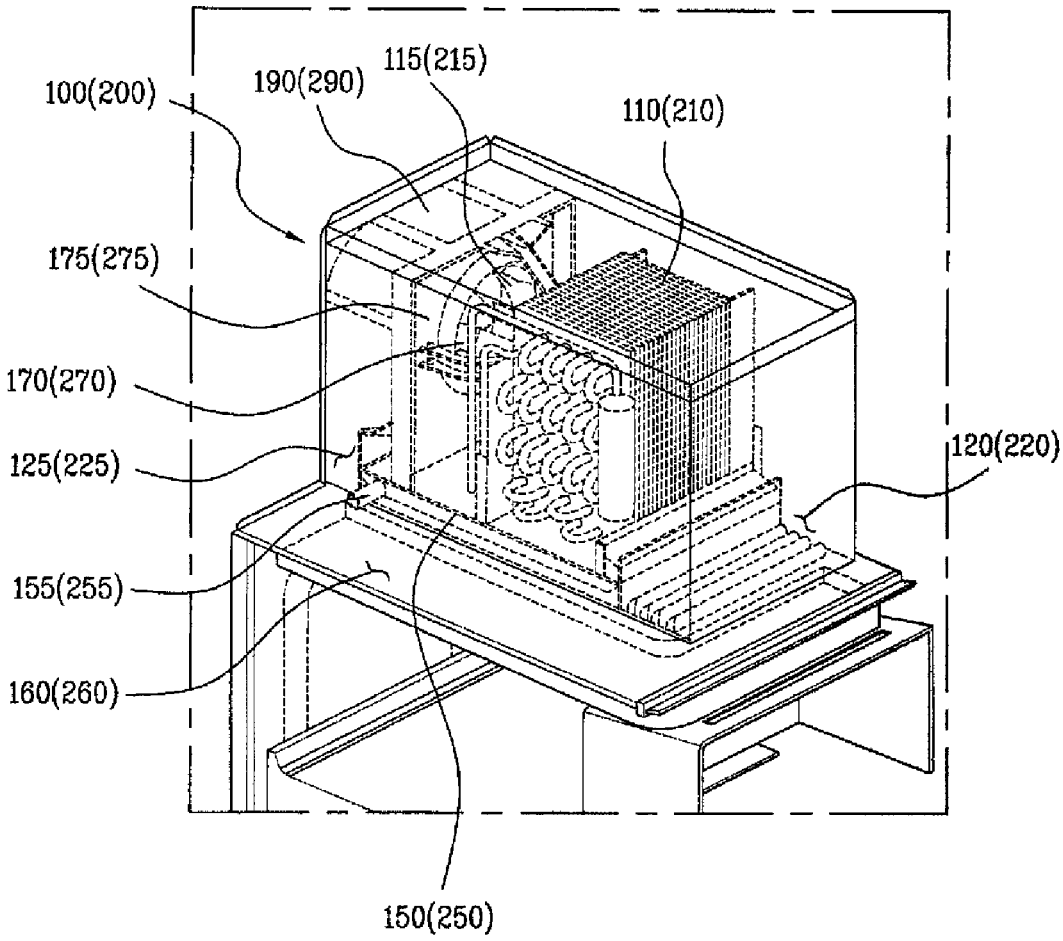
FIG. 5 is a structure view of a freezing chamber and a cold air generation chamber for a refrigerating chamber.

FIG. 5 illustrates an example of the cold air generation chamber for the refrigerating chamber 200. The internal structure thereof is symmetrical with that of the cold air generation chamber for the freezing chamber 100, but they are the same in view of their entire structures. Therefore, the internal structures of both the cold air generation chamber for the refrigerating chamber 200 and the cold air generation chamber for the freezing chamber 100 will be described with respect to FIG. 5.

In the cold air generation chamber for the freezing chamber 100, the freezing chamber evaporator 110 is provided and a drain pan 150 is provided below the freezing chamber evaporator 110. The drain pan 150 receives defrosting water generated at the time of defrosting against the evaporator and discharges it to the external. A drain hole 155 is provided in the drain pan 150 so that defrosting water is discharged from the drain pan 150 and the discharged defrosting water is discharged to the outside of the cold air generation chamber for the freezing chamber 100 along a flow passage 160 provided around the drain pan 150.

The freezing chamber cold air fan 115 is provided on the side of the drain pan 150 The freezing chamber cold air fan 115 is operated by a fan motor 116 (see FIG. 6) disposed between the freezing chamber cold air fan 115 and the freezing chamber evaporator 110.

An orifice 175 that has a predetermined orifice hole 170 is provided around the freezing chamber cold air fan 115, and the fan motor 116 is supported by a motor supporting plate extended from the orifice 175.

A guide member 190 that guides the cold air discharged from the freezing chamber cold air fan 115 toward the cold air outlet 110 is provided on one surface of the orifice 175.

In the cold air generation chamber for the refrigerating chamber 200, since its temperature does not drop below zero, a separate defrosting operation like the defrosting operation against the refrigerating chamber evaporator 110 is not required, such that defrosting water is not generated.

However, when a condensation operation is generated as a relatively high temperature air comes from the refrigerating chamber when cold air is not heat-exchanged with the air in the refrigerating chamber evaporator 210 (for example, when heat-exchange with the cold air is not further required because the temperature of the refrigerating chamber remains at a proper range) meets the refrigerating chamber heat-exchanger 210, condensation water may be generated so that a drain pan 250 that receives the condensation water and discharges it to the external is used.

The drain pan 150 provided in the cold air generation chamber for the freezing chamber 100 as described above is substantially the same as that of the drain pan 250 provided in the cold air generation chamber for the refrigerating chamber 200.

Although both the drain pan 150 of the cold air generation chamber for the freezing chamber 100 and the drain pan 250 of the cold air generation chamber for the refrigerating chamber 200 are not shown together, a drain outlet 155 of the drain pan 150 of the cold air generation chamber for the freezing chamber 100 is disposed opposite to a drain outlet 255 of the drain pan 250 of the cold air generation chamber for the refrigerating chamber 200 in view of space utilization.

Figure 6:
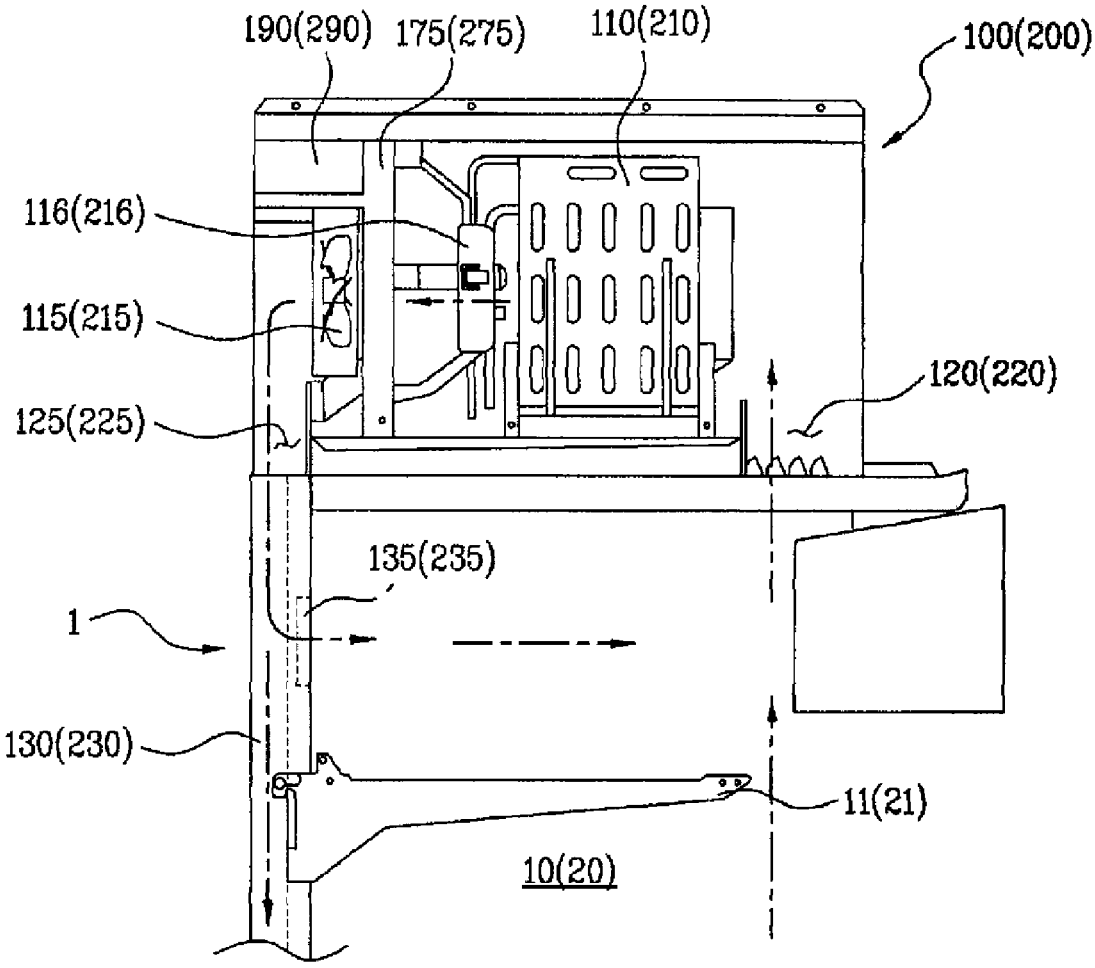
FIG. 6 is a side cross-sectional view of a freezing chamber and a cold air generation chamber for a refrigerating chamber.

FIG. 6 illustrates a cross-section of the cold air generation chamber for the freezing chamber 100 and a portion of the freezing chamber 10. As shown, the freezing chamber evaporator 110 and the freezing chamber cold air fan 115 are disposed between the first cold air inlet 120 and the first cold air outlet 125, and the guide member 190 is disposed in the rear of the orifice 175 to guide the air discharged from the freezing chamber cold air fan 115 toward the cold air outlet 125.

The freezing chamber cold air fan motor 116 is disposed between the freezing chamber cold air fan 115 and the freezing chamber evaporator 110. The freezing chamber cold air fan motor 116 is subject to the cooling process of air flowing into the freezing chamber cold air fan 115 from the freezing chamber evaporator 110, thereby making it possible to prevent mal-operation due to the over heating of the motor 116.

The first guide duct 130 is provided between the freezing chamber 10 and the inner wall of the main body 1, and a cold air outlet 135 is defined on an upper surface of the shelf 11 and the freezing chamber 10 or on a central portion of the space between adjacent shelves. The first guide duct 130 includes multiple cold air outlets that are defined along the first guide duct 130 and that distribute cooled air throughout the freezing chamber 10.

A cross-section of the cold air generation chamber for the refrigerating chamber 200 is substantially similar to that of the cold air generation chamber for the freezing chamber 100. For instance, the refrigerating chamber evaporator 210 is disposed between the second cold air inlet 220 and the second cold air outlet 225, and the refrigerating chamber cold air fan 215 is positioned adjacent to the second cold air outlet 225. In addition, the refrigerating chamber cold air fan 215 is surrounded by the orifice 275.

The guide member 290 provided in the orifice 275 is disposed between the orifice 275 and the rear wall of the cold air generation chamber for the refrigerating chamber 200 to guide the air discharged from the refrigerating chamber cold air fan 215 toward the second cold air outlet 225.

The refrigerating chamber cold air fan motor 216 is disposed between the refrigerating chamber cold air fan 215 and the refrigerating chamber evaporator 210. The refrigerating chamber cold air fan motor 216 is subject to the cooling process of air flowing to the freezing chamber cold air fan 215 from the refrigerating chamber evaporator 210, thereby making it possible to prevent mal-operation due to the over heating of the motor 216.

The second guide duct 230 connected to the second cold air outlet 225 is provided between the refrigerating chamber 20 and the inner wall of the main body 1, and a cold air outlet 235 is defined in the second guide duct 230 on an upper surface of the shelf 21 and the freezing chamber 10 or on a central portion of the space between adjacent shelves. The second guide duct 230 includes multiple cold air outlets that are defined along the second guide duct 230 and that distribute cooled air throughout the refrigerating chamber 20.

Figure 7:
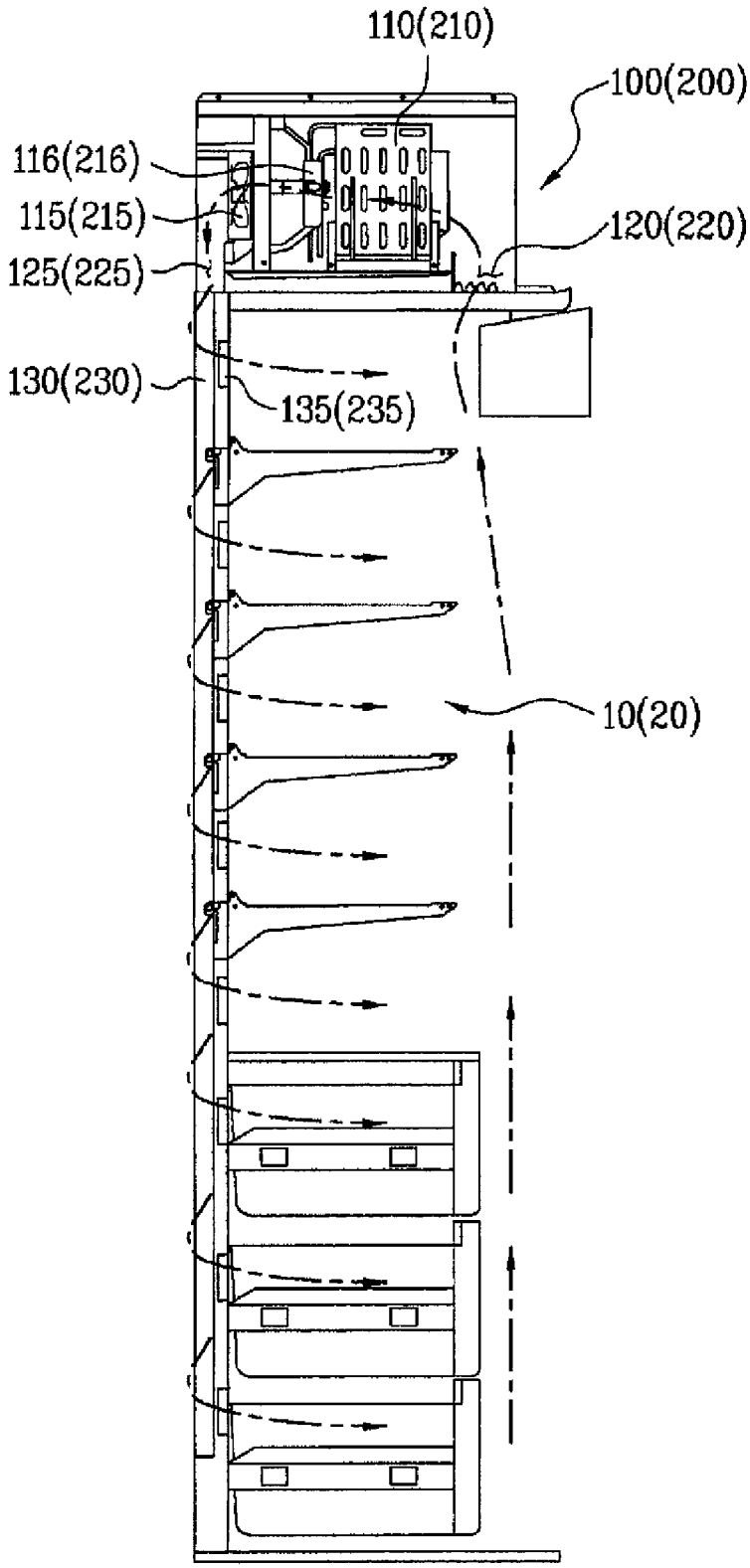
FIG. 7 is a cross-sectional view of an internal structure of a refrigerator.
Figure 8:
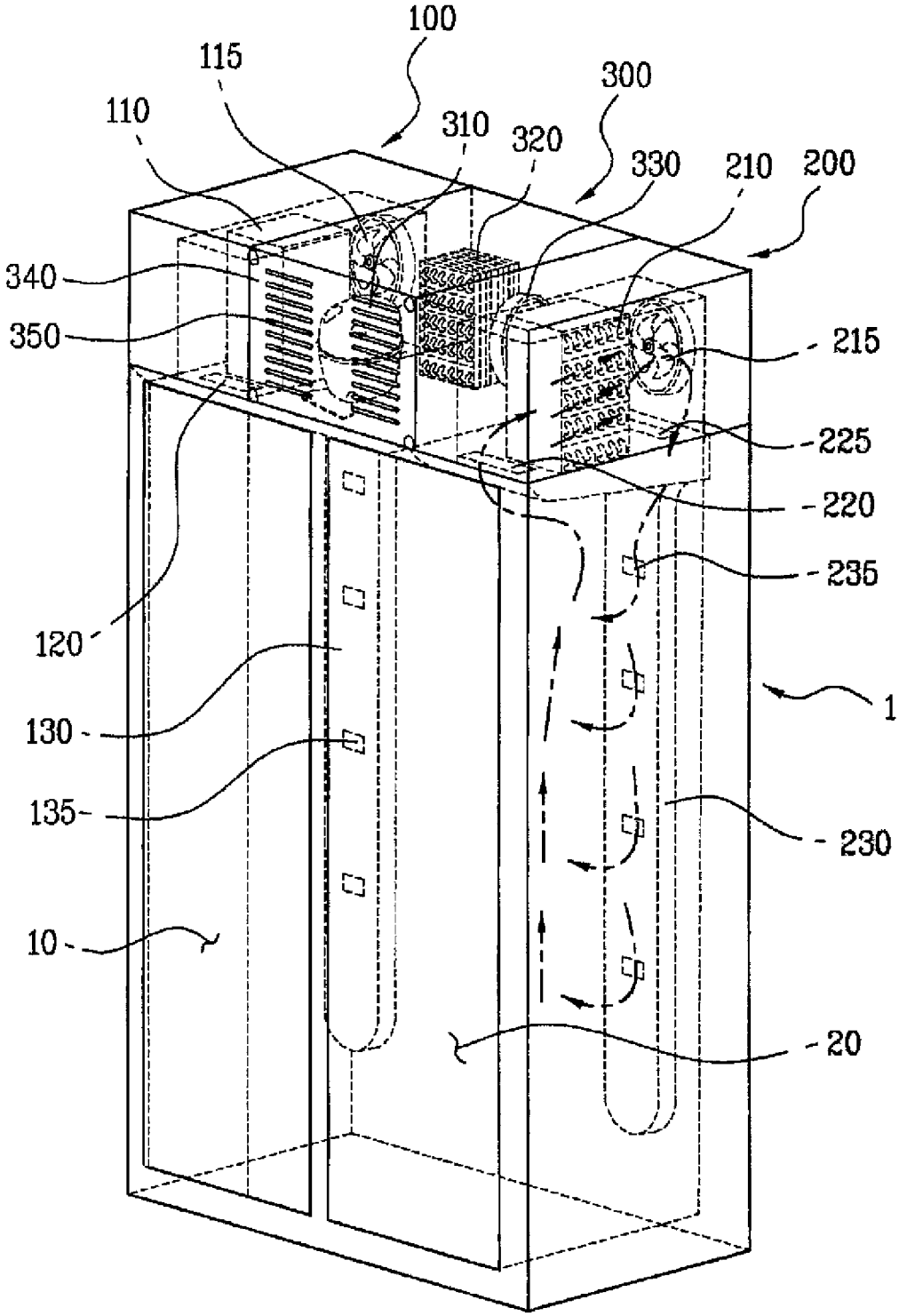
FIG. 8 is a perspective view showing a structure in which cold air of a freezing chamber is circulated in a refrigerator.
Figure 9:
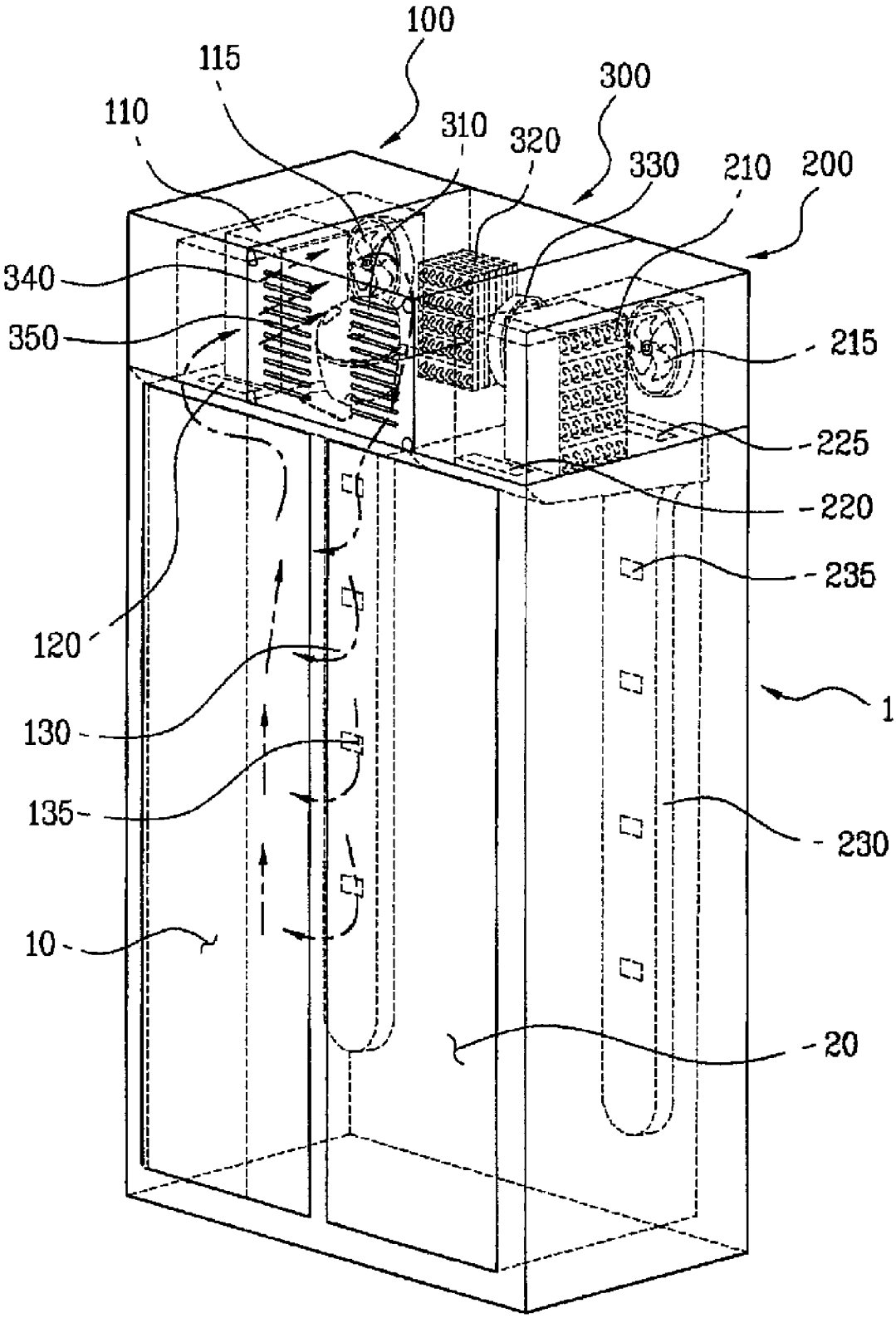
FIG. 9 is a perspective view showing a structure in which cold air of a refrigerating chamber is circulated in a refrigerator.

FIGS. 7-9 illustrate operation of the refrigerator. FIGS. 7 and 9 show a structure in which cold air circulates between the freezing chamber 10 and the cold air generation chamber for the freezing chamber 100. Here, the cross-sectional structure shown in FIG. 7 is applied in common to the freezing chamber 10, the refrigerating chamber 20, the cold air generation chamber for the freezing chamber 100, and the cold air generation chamber for the refrigerating chamber 200.

As described above, the freezing chamber 10 is driven by a separate-cooling type from the refrigerating chamber 20 and the cold air generated by the cold air generation chamber for the freezing chamber 100 flows into only the freezing chamber 10.

Reviewing the circulation of the cold air of the structure of the freezing chamber 10 and the cold air generation chamber for the freezing chamber 100, air that exists inside the freezing chamber 10 and has a certain degree of heat removed by stored goods moves to the cold air inlet 120 provided between the freezing chamber 10 and the cold air generation chamber for the freezing chamber 100 by the operation of the freezing chamber cold air fan 115.

The air passing through the first cold air inlet 120 passes through the freezing chamber evaporator 110 and undergoes a heat-exchange process in which air passing through the first cold air inlet 120 is cooled. Air having a lower temperature moves to the freezing chamber cold air fan 115.

The freezing chamber cold air fan 115 is a centrifugal fan or an axial flow fan. The cold air that passes through the freezing chamber evaporator 110 by the freezing chamber cold air fan 115 next passes through the cold air outlet 125 provided adjacent to the surrounding of the freezing chamber cold air fan 115. The guide duct 130 connected to the cold air outlet 125 receives the cooled air passing through the cold air outlet 125 and guides it to the freezing chamber 10. The guide duct 130 expels air throughout the freezing chamber 10 through the cold air outlets 135.

FIG. 8 shows a structure in which cold air circulates between the refrigerating chamber 20 and the cold air generation chamber for the refrigerating chamber 200. Here, the circulation of the cold air is substantially similar to that in the freezing chamber 10 and the cold air generation chamber for the freezing chamber 100, but is different in the temperature of circulated air.

The refrigerating chamber 20 is driven by a separate-cooling type from the freezing chamber 10 and the cold air generated by the cold air generation chamber for the refrigerating chamber 200 flows into only the refrigerating chamber 20.

Reviewing the circulation of the cold air of the structure of the refrigerating chamber 20 and the cold air generation chamber for the refrigerating chamber 200, air that exists inside the refrigerating chamber 20 and has a certain degree of heat removed by stored goods moves to the second cold air inlet 220 provided between the refrigerating chamber 20 and the cold air generation chamber for the refrigerating chamber 200 by the operation of the refrigerating chamber cold air fan 215.

The air passing through the second cold air inlet 220 passes through the refrigerating chamber evaporator 210 and undergoes a heat-exchange process in which air passing through the second cold air inlet 220 is cooled. The temperature of the cold air is greater than a freezing temperature (e.g., greater than zero degrees Celsius). Air having a lower temperature due to the heat-exchange is moved to the refrigerating chamber cold air fan 215.

The refrigerating chamber cold air fan 215 is a centrifugal fan or an axial flow fan. The cold air that passes through the refrigerating chamber evaporator 210 by the refrigerating chamber cold air fan 215 next passes through the second cold air outlet 225 provided adjacent to the surrounding of the freezing chamber cold air fan 215. The second guide duct 230 connected to the second cold air outlet 225 receives the cooled air passing through the cold air outlet 125, and guides it to the refrigerating chamber 20. The guide duct 230 expels air throughout the refrigerating chamber 20 through the cold air outlets 235.

In order that cold air is supplied to the freezing chamber evaporator 110 or the refrigerating chamber evaporator 210, after being compressed by the compressor 310, the cold air moves to the condenser 320 to be flowed into the respective evaporators, going through the condensation process and the predetermined expansion apparatus.

At this time, if the condensation fan 330 operates for the heat-exchange operation between the condenser 320 and the air, the external air of the machine room 300 is flowed in the direction of a communication hole 350 defined closer to the condenser 320, among communication holes 350 defined on the cover member 340, by the operation of the condensation fan 330 and then is subject to the heat-exchange operation with the condenser 320, thereby being discharged into the communication hole 350 defined on the other portion.

Through the air circulation operation as described above, the heat-exchange operation between the high-temperature cold air and the indoor air is made in the condenser 320.

In some implementations, both the cold air generation chamber for the refrigerating chamber and the cold air generation chamber for the freezing chamber are positioned on an uppermost part of the main body. Therefore, the refrigerator can reduce an increase in thickness of the refrigerator due to the respective cold air generation chambers being disposed in the rear of the refrigerating chamber and the freezing chamber, and can reduce the forward and backward thickness of the refrigerator thereby, making it possible to reduce the area occupied by the refrigerator when installing the refrigerator.

Also, the machine room is installed on the upper part of the main body, so that the space of the freezing chamber or the refrigerating chamber can be enlarged, as compared to refrigerators in which the machine room is installed in the lower rear of the freezing chamber or the refrigerating chamber. Accordingly, the storage space of the refrigerating chamber and freezing chamber may be increased.

It will be understood that various modifications may be made without departing from the spirit and scope of the claims. For example, advantageous results still could be achieved if steps of the disclosed techniques were performed in a different order and/or if components in the disclosed systems were combined in a different manner and/or replaced or supplemented by other components. Accordingly, other implementations are within the scope of the following claims.

What is claimed is:

1. A refrigerator, comprising:

a main body;

a refrigerating chamber defined at a first portion of the main body;

a freezing chamber defined at a second portion of the main body, the second portion of the main body being different than the first portion of the main body;

a cold air generation chamber for the freezing chamber defined at an uppermost part of the main body and configured to generate cold air used in regulating temperature of the freezing chamber, the cold air generation chamber for the freezing chamber extending across the uppermost part of the main body from a front portion of the main body to a rear portion of the main body;

a cold air generation chamber for the refrigerating chamber defined at the uppermost part of the main body and configured to generate cold air used in regulating temperature of the refrigerating chamber, the cold air generation chamber for the refrigerating chamber extending across the uppermost part of the main body from the front portion of the main body to the rear portion of the main body;

a freezing chamber cold air inlet that allows air to flow from the freezing chamber into the cold air generation chamber for the freezing chamber;

a refrigerating chamber cold air inlet that allows air to flow from the refrigerating chamber into the cold air generation chamber for the refrigerating chamber; and a machine room defined at the uppermost part of the main body, the machine room being positioned between the cold air generation chamber for the freezing chamber and the cold air generation chamber for the refrigerating chamber, the machine room extending across the uppermost part of the main body from the front portion of the main body to the rear portion of the main body, wherein the freezing chamber cold air inlet is disposed at a front portion of the cold air generation chamber for the freezing chamber and the refrigerating chamber cold air inlet is disposed at a front portion of the cold air generation chamber for the refrigerating chamber.

2. The refrigerator according to claim 1, wherein the freezing chamber and the refrigerating chamber are defined in the main body in parallel with each other, the cold air generation chamber for the freezing chamber being disposed on an uppermost surface of the freezing chamber and the cold air generation chamber for the refrigerating chamber being disposed on an uppermost surface of the refrigerating chamber.

3. The refrigerator according to claim 2, wherein the cold air generation chamber for the freezing chamber and the cold air generation chamber for the refrigerating chamber are spaced apart from each other and the machine room is disposed in a space between the cold air generation chamber for the freezing chamber and the cold air generation chamber for the refrigerating chamber.

4. The refrigerator according to claim 1, further comprising:

a freezing chamber evaporator and a freezing chamber cold air fan that are positioned in the cold air generation chamber for the freezing chamber; and a freezing chamber cold air outlet that allows air to discharge from the cold air generation chamber for the freezing chamber to the freezing chamber, the freezing chamber evaporator being positioned between the freezing chamber cold air inlet and the freezing chamber cold air outlet.

5. The refrigerator according to claim 4, further comprising:

a guide duct connected to the freezing chamber cold air outlet, positioned inside of the freezing chamber, and configured to guide cold air discharged from the freezing chamber cold air outlet to an inside of the freezing chamber.

6. The refrigerator according to claim 4, wherein the freezing chamber cold air fan is positioned adjacent to the freezing chamber cold air inlet or the freezing chamber cold air outlet.

7. The refrigerator according to claim 4, wherein the freezing chamber cold air fan includes a fan motor that is positioned between the freezing chamber evaporator and the freezing chamber cold air fan and along an air flow path of cold air being drawn from the freezing chamber evaporator by the freezing chamber cold air fan.

8. The refrigerator according to claim 1, further comprising:

a refrigerating chamber evaporator and a refrigerating chamber cold air fan that are positioned in the cold air generation chamber for the refrigerating chamber, and a refrigerating chamber cold air outlet that allows air to discharge from the cold air generation chamber for the refrigerating chamber to the refrigerating chamber, the refrigerating chamber evaporator being positioned between the refrigerating chamber cold air inlet and the refrigerating chamber cold air outlet.

9. The refrigerator according to claim 8, further comprising:

a guide duct connected to the refrigerating chamber cold air outlet, positioned inside of the refrigerating chamber, and configured to guide cold air discharged from the refrigerating chamber cold air outlet to an inside of the refrigerating chamber.

10. The refrigerator according to claim 8, wherein the refrigerating chamber cold air fan includes a fan motor that is positioned between the refrigerating chamber evaporator and the refrigerating chamber cold air fan and along an air flow path of cold air being drawn from the refrigerating chamber evaporator by the refrigerating chamber cold air fan.

11. The refrigerator according to claim 1, wherein the machine room defines a receiving space, further comprising:

a compressor and a condenser that are located in the receiving space defined by the machine room; and a cover member that is installed on a surface of the machine room in a manner that enables removal and replacement of the cover member, that is configured to cover the receiving space defined by the machine room, and that includes communication holes that are defined on the cover member and that enable communication of air between the receiving space defined by the machine room and an exterior of the refrigerator.

12. The refrigerator according to claim 1, wherein the machine room is positioned over an uppermost surface of the freezing chamber and an uppermost surface of the refrigerating chamber.

13. A refrigerator, comprising:

a main body;

a refrigerating chamber defined at a first portion of the main body;

a freezing chamber defined at a second portion of the main body, the second portion of the main body being different than the first portion of the main body;

a cold air generation chamber for the freezing chamber defined at an uppermost part of the main body and configured to generate cold air used in regulating temperature of the freezing chamber, the cold air generation chamber for the freezing chamber extending across the uppermost part of the main body from a front portion of the main body to a rear portion of the main body;

a cold air generation chamber for the refrigerating chamber defined at the uppermost part of the main body and configured to generate cold air used in regulating temperature of the refrigerating chamber, the cold air generation chamber for the refrigerating chamber extending across the uppermost part of the main body from the front portion of the main body to the rear portion of the main body;

a first cold air inlet through which air from the freezing chamber passes into the cold air generation chamber for the freezing chamber;

a second cold air inlet through which air from the refrigerating chamber passes into the cold air generation chamber for the refrigerating chamber; and a machine room provided on the uppermost part of the main body in parallel with the cold air generation chamber for the freezing chamber and the cold air generation chamber for the refrigerating chamber, the machine room extending across the uppermost part of the main body from the front portion of the main body to the rear portion of the main body, wherein the first cold air inlet is disposed at a front portion of the cold air generation chamber for the freezing chamber and the second cold air inlet is disposed at a front portion of the cold air generation chamber for the refrigerating chamber.

14. The refrigerator according to claim 13, further comprising:

a first guide duct that is configured to guide cold air discharged from the cold air generation chamber for the freezing chamber to the freezing chamber and that is installed in the freezing chamber; and a second guide duct that is configured to guide cold air discharged from the cold air generation chamber for the refrigerating chamber to the refrigerating chamber and that is installed in the refrigerating chamber.

15. The refrigerator according to claim 13, further comprising:

a freezing chamber evaporator and a freezing chamber cold air fan that are installed in the cold air generation chamber for the freezing chamber, the freezing chamber cold air fan being oriented to guide air passing through the freezing chamber evaporator toward the freezing chamber;

a refrigerating chamber evaporator and a refrigerating chamber cold air fan that are installed in the cold air generation chamber for the refrigerating chamber, the refrigerating chamber cold air fan being oriented to guide air passing through the refrigerating chamber evaporator toward the refrigerating chamber.

16. The refrigerator according to claim 15, wherein:

the freezing chamber cold air fan includes a first motor that is positioned between the freezing chamber evaporator and the freezing chamber cold air fan and along an air flow path of cold air being drawn from the freezing chamber evaporator by the freezing chamber cold air fan; and the refrigerating chamber cold air fan includes a second motor that is positioned between the refrigerating chamber evaporator and the refrigerating chamber cold air fan and along an air flow path of cold air being drawn from the refrigerating chamber evaporator by the refrigerating chamber cold air fan.

17. The refrigerator according to claim 13, further comprising:

a freezing chamber evaporator and a freezing chamber cold air fan that are installed in the cold air generation chamber for the freezing chamber, the freezing chamber cold air fan being oriented to guide air from the freezing chamber toward the cold air generation chamber for the freezing chamber;

a refrigerating chamber evaporator and a refrigerating chamber cold air fan that are installed in the cold air generation chamber for the refrigerating chamber, the refrigerating chamber cold air fan being oriented to guide air from the refrigerating chamber toward the cold air generation chamber for the refrigerating chamber.

18. The refrigerator according to claim 17 further comprising a guide member that guides air discharged from the first cold air fan and that is provided around the first cold air fan.

19. The refrigerator according to claim 17, further comprising:

a first cold air outlet through which air from the cold air generation chamber for the freezing chamber is discharged to the freezing chamber;

a second cold air outlet through which air from the cold air generation chamber for the refrigerating chamber is discharged to the refrigerating chamber, the freezing chamber evaporator installed in the cold air generation chamber for the freezing chamber being positioned between the first cold air inlet and the first cold air outlet and the refrigerating chamber evaporator installed in the cold air generation chamber for the refrigerating chamber being positioned between the second cold air inlet and the second cold air outlet.

20. The refrigerator according to claim 13, wherein the machine room is positioned between the cold air generation chamber for the freezing chamber and the cold air generation chamber for the refrigerating chamber, and defines a receiving space, further comprising:

a compressor and a condenser that are located in the receiving space defined by the machine room; and a cover member that is installed on a surface of the machine room in a manner that enables removal and replacement of the cover member to open and close the receiving space defined by the machine room, and that includes communication holes that are defined on the cover member and that enable communication of air between the receiving space defined by the machine room and an exterior of the refrigerator.

* * * * *